US005078281A

United States Patent [19]

Johnson

[11] Patent Number: 5,078,281

[45] Date of Patent: Jan. 7, 1992

[54] MECHANIC'S WORK TRAY WITH MAGNETIC SWINGABLE SUPPORT BRACKET

[76] Inventor: Jeffrey E. Johnson, 4725 W. 98th St., Bloomington, Minn. 55437

[21] Appl. No.: 605,503

[22] Filed: Oct. 30, 1990

[51] Int. Cl.[5] ..... A47F 5/00

[52] U.S. Cl. ..... 211/88; 211/DIG. 1; 248/206.5

[58] Field of Search ..... 211/88, 86, DIG. 1, 211/99, 170; 248/206.5, 309.4, 291

[56] References Cited

U.S. PATENT DOCUMENTS

| | | | |
|---|---|---|---|
| 2,201,828 | 5/1940 | Harding | 248/137 X |
| 2,958,566 | 11/1960 | Buck | 211/86 X |
| 2,962,333 | 11/1960 | Policastro | 211/86 X |
| 2,978,215 | 4/1961 | Shanok et al. | 248/206.5 X |
| 3,116,022 | 12/1963 | Davis | 248/291 X |
| 3,994,465 | 11/1976 | Rudnitzky | 211/88 X |
| 4,832,299 | 5/1989 | Gorton et al. | 248/291 X |

*Primary Examiner*—Robert W. Gibson, Jr.
*Attorney, Agent, or Firm*—Haugen and Nikolai

[57] ABSTRACT

A tool tray arrangement, including a magnetic hanging bracket, is disclosed. The bracket is swingably attached to the end walls of the tray. The tray's box may include a parabolic, concave or coved edges so that articles placed in the box will tend to gravitate toward the box's center. The device is particularly helpful when it is important to have a storage tray available at the point of repair when engaged in automobile repair or maintenance projects.

3 Claims, 2 Drawing Sheets

MECHANIC'S WORK TRAY WITH MAGNETIC SWINGABLE SUPPORT BRACKET

BACKGROUND OF THE INVENTION

This invention relates to portable trays or boxes used to temporarily store tools and/or parts when engaging in, for example, automobile repair projects. More particularly, this invention relates to a portable tray tool and/or parts retaining tray which may be detachably secured to a metallic surface at a location convenient for the user. In particular, this device is unusually helpful when it is desirabe to have a storage tray at the point of repair.

Various items are employed by those who repair or maintain automobiles. Whether a mechanic or other person is working on the automobile from above the engine compartment or from beneath its frame, tools are a general necessity. Unfortunately, keeping track of and temporarily storing these tools often becomes a task in itself for the individual dealing with the repair or maintenance project. One may place, for example, an Allen wrench or other tool at a place within the engine compartment which, while convenient for placement purposes is difficult to see. Minutes later when the user requires use of the tool, he or she invariably has forgotten where the tool was placed, and may end up extensively searching the engine compartment before relocating the tool.

Further, many parts one encounters when repairing or maintaining an automobile are of small size. These include fasteners such as screws, nuts, bolts, and the like. A dropped part of this type may be forever lost, damaged, or at the least, difficult to relocate.

In order to remedy the above noted problems, the mechanic or other person who repairs or maintains automobiles may wish to use a portable tray or similar device to temporarily store tools, or components while working on the automobile. Certain disadvantages are inherent in such use, however. For example, one working above the engine compartment may find that no convenient place exists in the compartment where the tray may be placed, with surfaces available within the engine compartment being either to small, not level, or otherwise inconveniently located. Tools or parts placed in a precariously placed tray may tend to spill out of the tray or cause the tray to shift. One working beneath the frame would invariably be in the position of necessarily placing the tray on the floor. Using the tray in such a way may well create problems due to the probability that its placement will be, by necessity, inconvenient at best.

At least one further problem may be encountered if using a conventional tool/parts tray. Because conventional trays are normally flat, with walls being at a 90 degree angle from the floor, small parts or tools may tend to gravitate to the corners or sides of the tray. This in turn may make it quite inconvenient for the user to retrieve items placed in the tray without lifting and turning over the tray, an act which may cause spilled tools or parts to be lost and/or damaged.

Therefore, what is needed is a portable tool receiving and/or storage tray capable of being easily, securely, and releasably placed in a location convenient for the worker. Further, such a storage tray should be capable of being positioned or retained at such an angle that the tray is both flat and secure. Finally, the tray should be designed in such a way that items placed therein are easily retrieved, i.e. do not gravitate toward the edges of the tray.

SUMMARY OF THE INVENTION

The present invention obviates the above described problems and difficulties by providing a storage tray arrangement which is provided with a magnet containing a bracket for releasably securing or hanging the tray's box at a convenient location. The bracket is pivotally or swingably attached to the end walls of the box. Further, the area within the box where the side walls meet the floor may be coved or rounded so that articles within it will tend to move toward its center, making part or tool retrieval convenient.

The box portion of the tray is pivotally fastened to the bracket through the use of thumb screws which are easily tightened or loosened by hand. The magnet containing bracket may be attached to any metallic surface, irrespective of surface angle. The angular position of the box portion is then adjusted by loosening the thumb screws and tilting the box until it is reasonably level. The screws are then tightened, resulting in a situation whereby the box is secure, stable and level.

Because the box portion of the tray does not sit flat on a surface, the box may contain coved edges without sacrificing any normal working stability whatsoever. The parabolic, concave or coved edges prevent parts or tools retained or placed in the box from gravitating toward the edges or corners, thus aiding in allowing efficient retrieval of such parts or tools by the user.

DETAILED DESCRIPTION OF THE INVENTION

Figure 1:
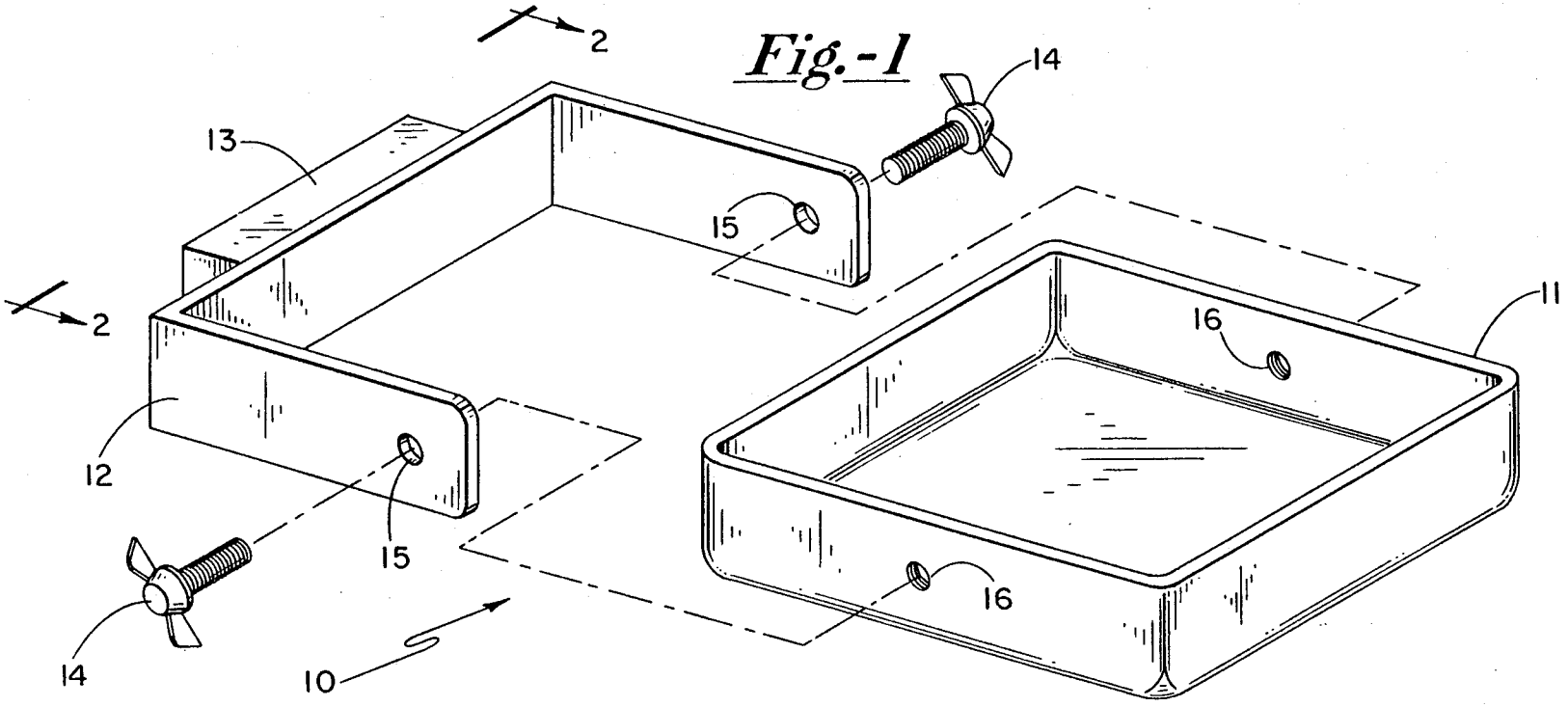
FIG. 1 is a perspective view of the novel tray and all of its components, including the magnet, the bracket, the thumb screws, and the tool and parts retaining box.

With attention being directed to FIG. 1 there is illustrated a tray generally designated 10 along with its component parts including the box portion 11, support bracket 12, magnet 13, thumb screws 14, and holes 15 and 16 bored through bracket 12 and box 11 for accepting said thumb screws.

Figure 2:
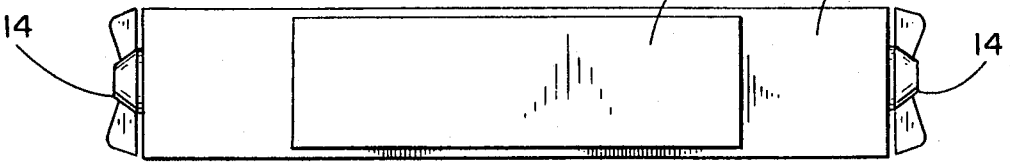
FIG. 2 is a rear view of the device revealing the magnet-containing bracket as it is attached to the box portion of the tray.

With attention being directed to FIG. 2 there is illustrated tray 10 revealing the magnet 13 as attached to the magnet containing bracket 12.

Figure 3:
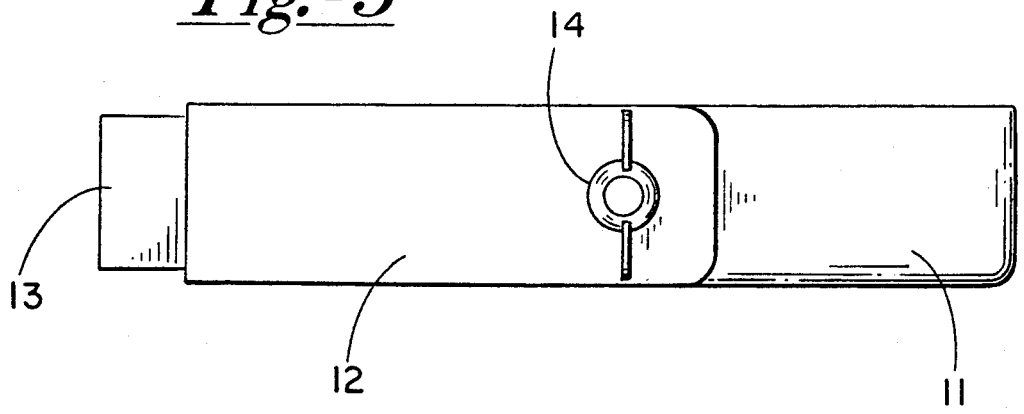
FIG. 3 is a side elevational view of the tray, revealing the magnet containing bracket as it is attached to the box portion.

FIG. 3 shows the arrangement of the tray 10 including box 11, bracket 12, magnet 13, and thumb screw 14.

Figure 4:
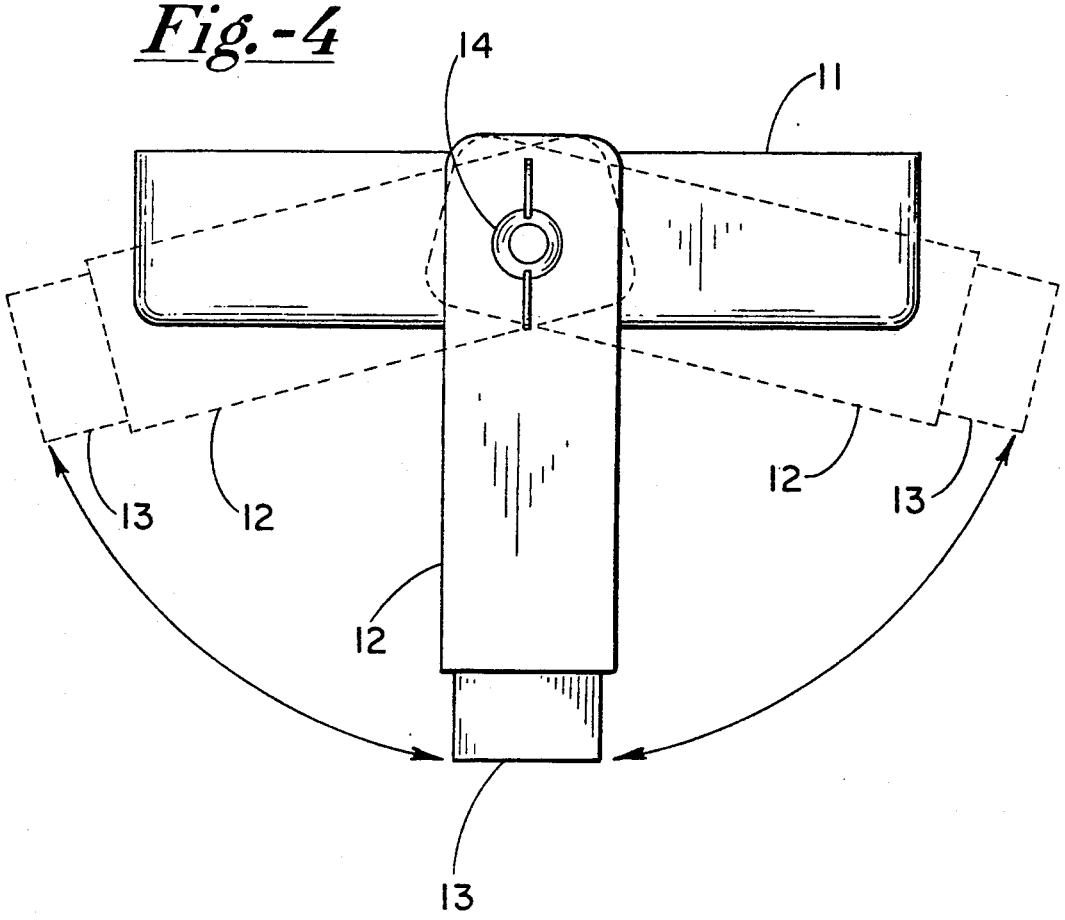
FIG. 4 reveals the rotatable nature of the box portion as it is to the handle device, along with those components noted in FIG. 3.

FIG. 4 illustrates the rotatable nature of the box 11 relative to other components. When thumb screws 14 are loose, box 11 will be permitted to rotate while bracket 12 remains stationary due to magnet 13 being affixed or attracted through magnetic force to a solid metal object. Thus, box 11 may be put into a level position irrespective of the placement or disposition of bracket 12.

USE OF THE INVENTION

When actually using the invention, the mechanic utilizing the improved tray will load the box portion with what ever items are expected to be required in the course of the undertaking contemplated. In the event the mechanic or other person is required to lie beneath the article being repairing such as a vehicle engine or the like, the bracket portion may be conveniently attached to the underside of the vehicle through the member 13. With the member 13 releasably secured in place, the box portion may then be tilted at the desired angle through the thumb screws 14—14, or alternatively through use of screws with knurled edges. In leu of two thumb screws 14—14, one thumb screw may be used in conjunction with a pivoting cylindrical support member in one of the holes bored through bracket 12 and box 11. Thereafter, as the actual operation progresses, individual parts may be dropped into the box portion and retain there until required for replacement on the vehicle or other article project. Also, tools, as required, may be readily grasped and lifted from the box portion in the order and/or sequence required. All in all, the tools, parts, components, and the like are held at a desired location, and are thus readily accessible to the user of on an as-required basis.

It will be appreciated, of course, that other variations of the features and embodiments described here and may be prepared without actually departing from the scope of the present invention.

I claim:

1. A tray arrangement comprising:

(A) a box compartment having a bottom surface surrounded by four upstanding walls;

(B) said upstanding walls joining said bottom surface along lateral edge portions of said bottom surface;

(C) said bottom surface having a concave portion along said lateral edge portions so as to provide a coved bottom surface;

(D) said box compartment being pivotally attached to a bracket with a pivotal attachment means; and (E) said bracket being of a generally U shaped configuration and having a magnet attached thereto for removable attachment of said tray arrangement to a metallic surface.

2. The invention as defined in claim 1, wherein:

said pivotal attachment means includes at least one thumb screw with knurled edges.

3. A tray arrangement comprising:

(A) a box compartment having a bottom surface surrounded by four upstanding walls;

(B) said upstanding walls joining said bottom surface along the lateral edge portions of said bottom surface;

(C) said box compartment being pivotally attached to a bracket with a pivotal attachment means; and (D) said bracket being of a generally "U"-shaped configuration and having a magnet attached thereto for removable attachment of said tray arrangement to a metallic surface.

* * * * *